US009010104B2

(12) United States Patent
Rampen et al.

(10) Patent No.: US 9,010,104 B2
(45) Date of Patent: Apr. 21, 2015

(54) FLUID-WORKING MACHINE VALVE TIMING

(75) Inventors: William Hugh Salvin Rampen, Edinburgh (GB); Uwe Bernhard Pascal Stein, Edinburgh (GB); Niall James Caldwell, Edinburgh (GB); Stephen Michael Laird, Edinburgh (GB); Pierre Robert Joly, Edinburgh (GB); Michael Richard Fielding, Linlithgow (GB); Daniil Sergeevich Dumnov, Edinburgh (GB)

(73) Assignee: Artemis Intelligent Power Limited, Loanhead (GB)

( * ) Notice: Subject to any disclaimer, the term of this patent is extended or adjusted under 35 U.S.C. 154(b) by 738 days.

(21) Appl. No.: 13/320,855

(22) PCT Filed: Feb. 23, 2011

(86) PCT No.: PCT/GB2011/050358

§ 371 (c)(1),
(2), (4) Date: Nov. 16, 2011

(87) PCT Pub. No.: WO2011/104547

PCT Pub. Date: Sep. 1, 2011

(65) Prior Publication Data

US 2012/0063919 A1 Mar. 15, 2012

(30) Foreign Application Priority Data

Feb. 23, 2010 (GB) ..... 1003006.2
Feb. 23, 2010 (GB) ..... 1003007.0

(51) Int. Cl.
*F04B 51/00* (2006.01)
*F04B 49/22* (2006.01)

(52) U.S. Cl.
CPC ..... *F04B 51/00* (2013.01); *F04B 49/22* (2013.01)

(58) Field of Classification Search
USPC ..... 60/459; 91/243, 248
See application file for complete search history.

(56) References Cited

U.S. PATENT DOCUMENTS 3,021,684 A 11/1962 Berck
4,909,982 A 3/1990 Ezekoye
(Continued)

FOREIGN PATENT DOCUMENTS

EP 1898186 3/2008
EP 2055943 5/2009
(Continued)

OTHER PUBLICATIONS

Rampen, W.H.S., Almond and S.H. Salter, "The Digital Displacement Pump/Motor Operating Cycle: Experimental Results Demonstrating the Fundamental Characteristics" Bath 1994.
(Continued)

*Primary Examiner* — Thomas E Lazo
(74) *Attorney, Agent, or Firm* — Lowe Hauptman & Ham, LLP

(57) ABSTRACT

A fluid-working machine has a working chamber of cyclically varying volume, high and low pressure manifolds, and high and low pressure valves for regulating the flow of fluid between the working chamber and the high and low pressure manifolds respectively. A controller actively controls at least one said valve to determine the net displacement of working fluid of the working chamber on a cycle by cycle basis. At least one said valve is a variable timing valve and the controller causes the valve to open or close at a time determined taking into account one or more properties of the performance of the fluid working machine measured during an earlier cycle of working chamber volume.

37 Claims, 4 Drawing Sheets

(56) References Cited

U.S. PATENT DOCUMENTS

| | | | | |
|---|---|---|---|---|
| 5,190,446 | A | 3/1993 | Rampen et al. | |
| 5,259,738 | A | 11/1993 | Rampen et al. | |
| 6,000,417 | A * | 12/1999 | Jacobs | 137/2 |
| 6,106,238 | A | 8/2000 | Ciavarini et al. | |
| 6,364,623 | B1 | 4/2002 | Ciavarini et al. | |
| 6,443,717 | B1 | 9/2002 | Barber | |
| 6,604,908 | B1 | 8/2003 | Bryant et al. | |
| 2004/0253118 | A1 | 12/2004 | Inoue et al. | |
| 2007/0258832 | A1 * | 11/2007 | Caldwell et al. | 417/315 |
| 2009/0210120 | A1 * | 8/2009 | Stein et al. | 701/51 |
| 2009/0317266 | A1 * | 12/2009 | Rampen et al. | 417/53 |
| 2010/0037604 | A1 * | 2/2010 | Rampen et al. | 60/445 |
| 2010/0296948 | A1 * | 11/2010 | Kuttler et al. | 417/53 |
| 2010/0303657 | A1 | 12/2010 | Kuttler | |
| 2011/0226342 | A1 * | 9/2011 | Stein et al. | 137/2 |
| 2011/0268590 | A1 * | 11/2011 | Stein et al. | 417/298 |

FOREIGN PATENT DOCUMENTS

| | | | |
|---|---|---|---|
| EP | 2055945 | | 5/2009 |
| EP | 2055947 | | 5/2009 |
| GB | 2459520 | | 10/2009 |
| GB | 2459520 | A * | 10/2009 |
| JP | 5621036 | | 2/1981 |
| JP | 5503335 | | 6/1993 |
| JP | 5249018 | | 9/1993 |
| JP | 2001132646 | | 5/2001 |
| JP | 2004204768 | | 7/2004 |
| JP | 2007198272 | | 8/2007 |
| JP | 2008127993 | | 6/2008 |
| JP | 2012524195 | | 10/2012 |
| WO | 8705107 | | 8/1987 |
| WO | 9105163 | | 4/1991 |
| WO | 2007088380 | | 8/2007 |
| WO | 2008009950 | | 1/2008 |
| WO | 2008012558 | | 1/2008 |
| WO | 2008012587 | | 1/2008 |
| WO | 2009153605 | | 12/2009 |
| WO | 2011104547 | | 9/2011 |

OTHER PUBLICATIONS

Md. Ehsan, W H S Rampen, J R M Taylor, "Simulation and Dynamic Response of Computer Controlled Digital Hydraulic Pump/Motor System Used in Wave Energy Power Conversion Bath" 1991.

* cited by examiner

FLUID-WORKING MACHINE VALVE TIMING

RELATED APPLICATIONS

The present application is a National Phase of International Application Number PCT/GB2011/050358, filed Feb. 23, 2011 and claims priority from, British Application Number 1003006.2, filed Feb. 23, 2010, and British Application Number 1003007.0, filed Feb. 23, 2010.

FIELD OF THE INVENTION

The invention relates to fluid working machines which comprise at least one working chamber of cyclically varying volume in which the net displacement of fluid through the or each working chamber is regulated by at least one electronically controllable valve, on a cycle by cycle basis. The invention aims to facilitate the accurate and efficient operation of fluid working machines of this type.

BACKGROUND TO THE INVENTION

Fluid working machines include fluid-driven and/or fluid-driving machines, such as pumps, motors, and machines which can function as either a pump or as a motor in different operating modes.

When a fluid working machine operates as a pump, a low pressure manifold typically acts as a net source of fluid and a high pressure manifold typically acts as a net sink for fluid. When a fluid working machine operates as a motor, a high pressure manifold typically acts as a net source of fluid and a low pressure manifold typically acts as a net sink for fluid. Within this description and the appended claims, the terms "high pressure manifold" and "low pressure manifold" are relative, with the relative pressures being determined by the application. A fluid working machine may have more than one low pressure manifold and more than one high pressure manifold. First and second manifolds may operate as low and high pressure manifolds or high and low pressure manifolds respectively in alternative operating modes.

Although the invention will be illustrated with reference to applications in which the fluid is a liquid, such as a generally incompressible hydraulic liquid, the fluid could alternatively be a gas or a compressible liquid.

Fluid working machines are known which comprise a plurality of working chambers of cyclically varying volume, in which the displacement of fluid through the working chambers is regulated by electronically controllable valves, on a cycle by cycle basis and in phased relationship to cycles of working chamber volume, to determine the net throughput of fluid through the machine. For example, EP 0 361 927 disclosed a method of controlling the net throughput of fluid through a multi-chamber pump by opening and/or closing electronically controllable poppet valves, in phased relationship to cycles of working chamber volume, to regulate fluid communication between individual working chambers of the pump and a low pressure manifold. Valves which regulate the flow of fluid between a low pressure manifold and a working chamber are referred to herein as low pressure valves. As a result, individual chambers are selectable by a controller, on a cycle by cycle basis, to carry out an active cycle and displace a predetermined fixed volume of fluid or to undergo an idle cycle with no net displacement of fluid, thereby enabling the net throughput of the pump to be matched dynamically to demand.

EP 0 494 236 developed this principle and included electronically controllable poppet valves which regulate fluid communication between individual working chambers and a high pressure manifold, thereby facilitating the provision of a fluid working machine functioning as either a pump or a motor in alternative operating modes. Valves which regulate the flow of fluid between a high pressure manifold and a working chamber are referred to herein as high pressure valves. EP 1 537 333 introduced the possibility of part cycles, allowing individual cycles of individual working chambers to displace any of a plurality of different volumes of fluid to better match demand. GB 2430246 introduced a type of valve for regulating fluid communication between individual working chambers and a high pressure manifold, and a method of operating a machine with such a valve, that allowed the fluid working machine of EP 0 494 236 to develop a torque when stationary.

It is possible for these machines to fail if the timing of valve closure is not correct for the fluid pressure in the high pressure manifold. For example if, during a motoring cycle, a low pressure valve, such as a poppet valve, closes too late in the exhaust stroke to compress the trapped working fluid to at least the pressure of the high pressure manifold, then the high pressure valve of the respective working chamber will not open in preparation for drawing fluid from the high pressure manifold in a subsequent expansion stroke. Thus the motoring cycle is not possible and the machine malfunctions. In a second example, if the high pressure valve closes too late in the expansion stroke of a motoring cycle, this prevents the working chamber from sufficiently decompressing, thus preventing the respective low pressure valve from reopening to exhaust fluid from the working chamber and therefore causing fluid to be returned to the high pressure manifold on the compression stroke.

We have discovered that, in machines of this type, the properties of the working fluid change significantly in use, for example due to the ingress or absorption of air, water and other contaminants, operation at a wide range of temperatures and gradual deterioration over time. A particularly relevant and variable property is the fluid compressibility or bulk modulus. Also changes in fluid viscosity affect the rate of leakage of fluid out of the working chambers. Additionally the performance of the valves and other moving components can change over time as they wear, bed in or distort, or at different temperatures, causing them to individually act faster or slower at different times. Still further problems arise as fluid properties and valve performance are very difficult or expensive to measure during operation. In practice the operating fluid of a fluid working machine may be changed many times during its lifetime thereby changing the properties of the fluid, especially if fluid with different properties is selected on some occasions. Finally, it may be expensive to measure individual working chamber characteristics (such as leakage and valve closure times) during manufacture, and thus it may be desired to avoid calibrating the fluid working machine until it is used.

These factors conspire to reduce the accuracy of the flow into or out of the working machines, which is otherwise very accurately known. For example, closing the low pressure poppet valve at a selected phase relative to the cycle of working chamber volume would cause a smaller than expected volume to be pumped if the fluid compressibility or leakage was higher than expected.

Changes in the fluid properties can even cause the fluid working machine to fail in operation. For example an uncompensated increase in fluid compressibility or leakage would may mean that a low pressure poppet valve would close too late to sufficiently pressurise the working chamber and then open the high pressure valve in preparation for a motoring cycle. Thus the motoring cycle is not possible and the machine malfunctions. A second example is when an unexpected increase in compressibility or decrease in leakage prevents the working chamber from sufficiently decompressing at the end of the intake stroke of a motoring cycle, after the closure of the high pressure valve, thus preventing the low pressure valve from reopening.

In machines according to the prior art, the timing of closure of high and low pressure valves must always be conservative (i.e. early) to ensure that correct operation is achieved over the full range of fluid properties. However, this reduces the efficiency and capability of the machine because less fluid is displaced than would be the case were the timing less conservative. Also the closure of high and low pressure valves at times of higher flow creates more noise and could reduce the life of the valves, and can create undesirable torque and pressure ripple in the flow output of the fluid working machine.

Therefore aspects of the invention aim to increase the performance of a fluid working machine employing electronically controllable valves, operating over a range of fluid conditions or with component performance that varies over time, or to enable reduced specification electronically controllable valves to be employed than would otherwise be the case to obtain a fluid working machine with certain specified performance characteristics. Further aspects of the invention address the problem of measuring relevant properties of valve function in use.

SUMMARY OF THE INVENTION

According to a first aspect of the present invention there is provided a method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, characterised by the method comprising measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle.

The invention also extends in a second aspect to a fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller operable to actively control either or both the low pressure valve and the high pressure valve to determine the net displacement of fluid by the working chamber on a cycle by cycle basis, at least one of the low pressure valve and the high pressure valve being a variably timed valve, the timing of the opening or closing of which is variable relative to cycles of working chamber volume, characterised by one or more measuring devices for measuring one or more properties of the performance of the fluid working machine and a timing regulator operable to determine the timing of the opening or closure of the variably timed valve taking into account properties measured by the one or more measuring devices during an earlier cycle of working chamber volume. The or each measuring device is typically a sensor selected from a pressure sensor, a temperature sensor, a vibration sensor, a noise sensor, a flow sensor, a current sensor, a voltage sensor, or a valve movement or position sensor. The timing regulator is typically the controller of the fluid working machine (e.g. a software module executed by the controller of the fluid working machine). The controller of the fluid working machine typically transmits valve control signals to actively open, actively close, hold open or hold closed, the variably timed valve and, in some embodiments, both the low and high pressure valves.

By controlling the timing of the opening or closing of the low pressure or high pressure valve (the said variably timed valve) taking into account one or more properties of the performance of the fluid working machine during an earlier cycle of working chamber volume, the machine can better adapt to varying properties of the working fluid and the components of the fluid working machine itself and run closer to the point at which the variably timed valve would fail to open or close correctly than would otherwise be the case. This method is also preferable to methods in which the timing of the opening or closing of the variably timed valve (e.g. phase relative to cycles of working chamber volume) is delayed from one cycle to the next until a failure occurs and then brought forward so that opening or closing occurs before that failure point. The method of invention is preferable as it avoids failures of a valve to open or close, which may not remediable and may allow a smaller margin for error in the time (e.g. phase) between the opening or closing of the variably timed valve and the time at which a failure to open or close would occur. Thus, the method may comprise predicting a time (such as the phase within a cycle of working chamber volume) at which the variably timed valve would fail to open or close correctly and ensuring that the variable timed valve is commanded to open or close before that time.

Typically, the one or more measured properties taken into account when controlling the timing of a variably timed valve associated with a first working chamber comprise or consist of properties associated with the function of the first working chamber, for example, properties of the timing of the opening or closing of the high or low pressure valve associated with the first working chamber, or pressure or other physical properties within the first working chamber or in fluid received into or displaced out of the first working chamber. However, it may be that the one or more measured properties comprise at least one measured property of the function of a second working chamber of the fluid working machine, for example, a property (such as entrained gas concentration) of working fluid within, received into or displaced out of the second working chamber.

Typically, the later cycle of working chamber volume is a subsequent cycle of the volume of the same working chamber as the earlier cycle of working chamber volume. However, in some embodiments the later cycle of working chamber volume is a later cycle of the volume of a different working chamber from the earlier cycle of working chamber volume. It may be that the later cycle begins before the earlier cycle completes.

Typically, the fluid working machine comprises a controller and the controller actively controls one or more actively controlled valves (comprising at least the variably timed valve) to determine the net displacement of fluid by the working chamber on a cycle by cycle basis. The controller typically controls the timing of the opening or closing of the variably timed valves although in principle the timing could be controlled by a first controller while a second controller determines whether valves open or close during specific cycles of working chamber volume.

Typically, the method comprises determining for each cycle of working chamber volume whether to open, close, hold open or hold closed, one or more actively controlled valves (comprising at least the variably timed valve) to select whether the working chamber executes an idle cycle in which substantially no net displacement of working fluid occurs or an active cycle in which a net displacement of working fluid occurs, and, where an active cycle is selected, it is the timing of the opening or closure of the variably timed valve which is determined taking into account the one or more properties measured during the earlier cycle. The net displacement of working fluid during each cycle may be determined by the controller by selecting which working chambers to command active cycles and which to command idle cycles, or by closed loop feedback using a measured pressure which is compared with a demanded pressure, according to the methods described in the prior art, for example as described in EP 0361927, EP 0494236 or EP 1537333 which are hereby incorporated by reference. Thus, the controller may select idle and active cycles to match output to a demand signal using closed loop feedback and may also employ a different closed loop feedback to control the precise timing of valve opening or closing events during active cycles.

By "actively control" we refer to enabling the controller to affect the state of an electronically controllable valve, in at least some circumstances, by a control mechanism which consumes power and is not exclusively a passive response, for example, the opening or closing of a valve responsive solely to the pressure difference across a valve. Related terms such as "active control" should be construed accordingly. Nevertheless, the primary low pressure valve, and one or more other electronically controllable valves, where present, are preferably also operable to open or close by passive means. The primary low pressure valve typically opens passively due to the drop in pressure within the working chamber, such as during an intake stroke. For example, the primary low pressure valve, or one or more other electronically controllable valves, where present, may, during at least some cycles, open passively due to a pressure difference and be selectively closable under the active control of the controller during a portion of the cycle.

Preferably the valve is also biased open or biased closed by a biasing means. Preferably the valve is moveable from a first position to a second position under active control, and movable from the second position to the first position by the biasing means. Preferably one of the first or second positions is a closed position, and the other is an opened position.

By "in phased relationship to cycles of working chamber volume" we mean that the timing of active control by the controller of the primary low pressure valve, and one or more other electronically controllable valves, where present, is determined with reference to the phase of the volume cycles of the working chamber. Accordingly, the fluid working machine typically comprises working chamber phase determining means, such as a position sensor. For example, where the cycles of working chamber volume are mechanically linked to the rotation of a shaft, the fluid working machine preferably comprises a shaft position sensor, and optionally a shaft speed sensor, and the controller is operable to receive a shaft position signal from the shaft position sensor, and optionally a shaft speed signal from a said shaft speed sensor. In embodiments which comprise a plurality of working chambers, with a phase difference between the volume cycles of different working chambers, the controller will typically be operable to determine the phase of individual working chambers.

By "actively control" (and related terms such as "active control") we include the possibilities that the controller is operable to selectively cause an electronically controllable valve to do one or more of open, close, remain open and/or remain closed. The controller may only be able to affect the state of an electronically controllable valve during a portion of a working cycle. For example, the controller may be unable to open the primary low pressure valve against a pressure difference during the majority of a working cycle when pressure within the working chamber is substantial. The timing of the opening or closing of a said variably timed valve may be controlled precisely although typically there will be some unpredictability as to when the valve will open or close respectively or even in some circumstances (e.g. shortly after start-up before many measurements have been taken) unpredictability as to whether the valve will open or close respectively.

Typically, the controller actively controls the electronically controllable primary low pressure valve, and one or more other electronically controllable valves where present, by transmitting a control signal either directly to an electronically controllable valve or to an electronically controllable valve driver, such as a semiconductor switch. By transmitting a control signal, we include transmitting a signal which denotes the intended state of an electronically controllable valve (e.g. open or closed) or a pulse which denotes that the state of an electronically controllable valve should be changed (e.g. that the valve should be opened or closed), or a pulse which denotes that the state of an electronically controllable valve should be maintained. The controller may transmit a signal on a continuous basis and stop or change the signal to cause a change in the state of an electronically controllable valve, for example, the electronically controllable primary low pressure valve, or one or more other electronically controllable valves where present, may comprise a normally closed solenoid opened valve which is held open by provision of an electric current and actively closed by switching off the current.

It may be that the (estimated, calculated or known) time required for the said variably timed valve (e.g. the low pressure valve or the high pressure valve) to open or close is taken into account when determining when the controller sends, stops sending, or changes the signal, as appropriate, to thereby control the timing of the opening or closing of a said variable timed valve.

Typically the timing of the opening or closing of the variably timed valve is controlled by changing the timing of command signals for or to the variably timed valve relative to the position of the shaft. In some embodiments it is the timing of command signals for or to the variably timed valve which is controlled. In other embodiments it is the timing of a first command signal for or to the variably timed valve relative to the timing of a second command signal for or to the variably timed valve which is controlled. Thus, it may be the length of a command signal for or to the variably timed valve which is controlled, or a duty cycle of a command signal. In some embodiments the timing of the opening or closing of the variably timed valve is controlled by changing the characteristics of command signals for or to the variably timed valve. Characteristics of command signals may include lengths or levels of current or voltage pulses, or the profile over time of current or voltage signals, or duty cycles of pulse width modulated current or voltage pulses. Thus, the command signals may be pulsed signals (e.g. pulse width modulated signals) and the timing of the opening or closing of the variably timed valve may be controlled by varying one or more of the amplitude, frequency or duty cycle of the pulses.

In some embodiments, the magnitude of the opening or closing force applied to a valve member (e.g. where the variably timed valve comprises an electromagnet, a valve seat and a valve member, the valve member comprising a poppet coupled to an armature in electromagnetic communication with the electromagnet) to urge the said variably timed valve open or closed respectively is also controlled taking into account the one or more properties measured during the earlier cycle. By the opening or closing force we refer to the mean force while the said variably timed valve is being actively urged to open or to close or is being actively held open or closed. This is significant as parameters such as the temperature or viscosity of working fluid, temperature or age of components of the fluid working machine such as the valves, pressure differentials across the variably timed valve, and the amount and type of entrained gas within working fluid can affect the force required for the variably timed valve to successfully open or close, or to open or close within an acceptable period of time. Thus, depending on the measured one or more properties, the opening or closing force during a later cycle can be increased or decreased. In some embodiments, the transmitted control signal communicates the magnitude of the opening or closing force. For example, the transmitted control signal may be a pulse width modulated signal in which the current or voltage of the signal is switched between two values and the duty cycle is varied to regulate the opening or closing force applied to the valve member. In this case, the signal may, for example, be applied (directly, or indirectly through an amplifier, switch etc.) to an electromagnet and the variably timed valve may comprise a valve member (e.g. a poppet coupled to an armature) in electromagnetic communication with the electromagnet.

Typically it is the timing of the opening or closing of the variably timed valve within the later cycle of working chamber which is controlled. The controller typically additionally determines whether the variably timed valve should be opened or closed as appropriate during each cycle. The timing may be the time at which the controller commands the variably timed valve to open or close and may differ from the time at which the variably timed valve begins to open or close.

The timing of the or each variably timed valve may be determined taking into account the one or more properties measured during the earlier cycle. However, it may that the timing of only one of a plurality of actively controlled valves associated with each individual working chamber is determined taking into account the one or more properties measured during the earlier cycle. The timing of actively controlled valves may take into account one or more properties of the performance of the fluid working machine during a plurality of earlier cycles, each of which is earlier than the later cycle. It is preferred that some or all of the measured properties are measured within the previous ten volume cycles of the working chamber with which the variable timed valve is associated. Preferably, some or all of the measured properties are measured during the volume cycle of the working chamber with which the variably timed valve is associated which immediately precedes the second cycle of working chamber volume. In embodiments where the method comprises determining for each cycle of working chamber volume whether to open, close, hold open or hold closed, one or more actively controlled valves, preferably the measured properties are measured during the active volume cycle of the working chamber with which the variably timed valve is associated which immediately precedes the second cycle of working chamber volume.

The method may be a method of actively controlling a motoring cycle of a fluid working machine. In this case, the high pressure valve is typically a said variably timed valve. Control of the precise time at which the high pressure valve closes during a motoring cycle (typically towards the end of the expansion stroke) is important as the pressure within the working chamber must then fall sufficiently low to enable the low pressure valve to open. We have found that the rate of pressure drop during a motoring cycle is surprisingly variable and non-linear due to the effects of entrained gas within received working fluid, which effervesces, affecting the rate of depressurisation in a manner which is highly sensitive to the species of the entrained gas, the concentration of the entrained gas, temperature and pressure. Surprisingly, we have found that the rate of closure of the high pressure valve also varies, for example due to magnetic remanence, eddy currents/flux, squeeze films and leakage. A smaller margin for error may be employed as the latest time at which the high pressure valve may be closed can be estimated based on the measured properties rather than simply assumed to be fixed for all conditions. Thus, the invention enables more working fluid to be received from the high pressure manifold during each cycle than could be reliably achieved by known methods.

However, in some embodiments the variably timed valve is the low pressure valve. Both the low pressure valve and high pressure valve associated with the working chamber may be variably timed valves, the timing of opening or closing of each of which is controlled during the second cycle of working chamber volume taking into account the one or more properties measured during the first cycle.

The method may comprise monitoring a parameter concerning the opening or closing of at least one of the low pressure valve and the high pressure valve and at least one measured property may concern the opening or closing of a monitored valve.

It may be that the variably timed valve is one of the said low pressure valve and the said high pressure valve and the monitored valve is the other of the said low pressure valve and the said high pressure valve. However, the monitored valve may be the variably timed valve.

The one or more parameters concerning the opening or closing of a monitored valve may comprise one or more of: whether the monitored valve opens during the earlier cycle of working chamber volume, whether the monitored valve closes during the earlier cycle of working chamber volume, when the monitored valve opens during the earlier cycle of working chamber volume, when the monitored valve closes during the earlier cycle of working chamber volume, when the monitored valve begins to close during the earlier cycle of working chamber volume, when the monitored valve begins to open during the earlier cycle of working chamber volume, the speed of opening of the monitored valve during the earlier cycle of working chamber volume, or the speed of closure of the monitored valve during the earlier cycle of working chamber volume.

The method may comprise measuring one or more of the period of time, the change in working chamber volume or the amount of shaft rotation which elapses between the controller signalling that a valve should open or close and the valve beginning and/or finishing opening or closing, as appropriate. These are important parameters which may vary significantly depending on the properties of the valve and the working fluid. Thus, the controller may take into account the said period of time when determining when to signal the opening or closing of the variably timed valve during the later cycle of working chamber volume.

One or more parameters concerning the opening or closing of the monitored valve may be determined from one or more of the pressure in the low pressure manifold, the pressure in the high pressure manifold, the pressure in the working chamber, the torque of a shaft mechanically linked to cycles of working chamber volume, or changes therein.

Typically measurements of one or more properties of the performance of the fluid working machine are taken into account selectively. For example, some measurements may be determined to be potentially erroneous or spurious and thereby disregarded. Thus, there may be measurements of one or more properties of the performance of the fluid working machine which are not taken into account in the control and timing of the opening or closing of a said variably timed valve during later cycles of working chamber volume. Although in some embodiments, all measurement that are made of the one or more properties of the fluid working machine are taken into account, it may be that in some embodiments only some of measurements that are made of the one or more properties of the performance of the fluid working machine are taken into account when controlling the timing of the opening or closing of a said variable timed valve during a later cycle of working chamber volume. Thus the method may further comprise, for at least some cycles of working chamber volume, measuring one or more properties of the performance of the fluid working machine during an earlier cycle of working chamber volume and determining not to take the said measured one or more properties into account when controlling the timing of the opening or closing of a said variably timed valve during a later cycle of working chamber volume. In some embodiments controlling the timing of the opening or closing of a said variably timed valve responsive to measurement of one or more properties of the performance of the fluid working machine during an earlier cycle of working chamber may be selectively temporarily inhibited, for example in response to determining that at least one of the measure one or more properties meets a disabling condition. A disabling condition may include said measurement of one or more properties being outside of an allowable range, a failure to measure said one or more properties, measurement of one or more properties at times other than expected, or measurement of one or more properties coinciding with other events known to interfere with the correct and accurate measurement of said one or more properties.

It may be that the variably timed valve is one of the low pressure valve and the high pressure valve and the method comprises monitoring one or more events which occur during the earlier cycle of working chamber volume after the controller instigates closure of the other of the low pressure valve and the high pressure valve and before the opening of the variably timed valve is completed. For example, the method may comprise measuring the rate of change of pressure within the working chamber at one or more times after the closure of the said other valve and before subsequent opening of the variably timed valve.

Typically, the opening or closing of the monitored valve which the measurements concern is actively controlled. However, the opening or closing of the monitored valve may occur passively as a result of change in working fluid pressure. Typically the method comprises monitoring a parameter associated with or responsive to the passive opening or closing of the monitored valve.

Although the method involves using one or more properties measured during an earlier cycle of working chamber volume, the timing of the opening or closing of the variably timed valve may be determined further taking into account a current value of a measured parameter associated with the working chamber. The current value is measured during the later cycle of working chamber volume and is typically the current (usually instantaneous) temperature or pressure of working fluid within the working chamber, or the rate of change of volume of the working chamber (i.e. the rotation speed of a shaft associated therewith). Typically the timing of the opening or closing of the variably timed valve is related to the current value of a measured parameter associated with the working chamber by a function. The one or more properties measured during an earlier cycle of working chamber volume may be used to modify the function relating the timing of the opening or closing of the variably timed valve to the current value of a measured parameter associated with the working chamber.

The measured valve (being the low pressure valve or high pressure valve) may be a solenoid operated valve comprising a solenoid. In this case, the method may comprise measuring at least one electrical property of a said solenoid to obtain at least one of the one or more measured properties. Parameters such as the speed of opening or closing of the measured valve can typically be determined from the measured electrical properties of the solenoid as a potential difference or current will typically be induced in the solenoid responsive to movement of the valve. The opening or closing of a measured valve may be detected by an acoustic sensor (to detect sound or vibrations arising from impact), an optical sensor, an electrical sensor (such as a switch) or magnetic sensor. The opening or closing of a valve may also be detected from pressure pulses in an inlet or outlet manifold, or within the working chamber. Whether or not a valve opens or closes may also be determined from whether the valve is detected as having latched in the open or closed position. This may be also be determined from an electrical property of the solenoid which varies depending on the relative distance between the solenoid and an armature, coupled to a valve head, upon which the solenoid acts, such as the inductance.

The method may comprise estimating the time required for at least one of the low pressure valve or the high pressure valve to either or both open or close, taking into account at least one of the one or more measured properties, and determining the timing of opening or closing of the variably timed valve taking into account the estimated time.

A look-ahead algorithm may be employed to determine expected values of measured properties during the later cycle from values measured during a plurality of earlier cycles. This is especially useful at times when one or more measured properties are changing rapidly, for example, during start up or shut down of the fluid working machine, or when the operating pressure of the fluid working machine is fluctuating.

It may be that the variably timed valve is one of the low pressure valve and the high pressure valve and the timing of the closing of the variably timed valve is optimised to maximise either or both of the efficiency and smoothness of the fluid working machine while avoiding failure of the other of the low pressure valve and the high pressure valve to open later in the same cycle of working chamber volume. It may be that the variable timed valve is instructed to open or close, as appropriate, a period of time before the latest determined time at which it could be instructed in order to open or close correctly, which period of time is initially relatively long relative to the period of cycles of working chamber volume when the machine is caused to start operating and which then decreases relative to the period of cycles of working chamber volume as operation continues, as the necessary margin of safety to avoid a failure of the variably timed valve to open or close during a specific cycle of working chamber volume may be decreased as additional measurements of properties are made, or trends in measured properties are calculated, or properties of the machine (e.g. temperature) stabilise.

It may be that the fluid working machine comprises a plurality of working chambers, wherein the one or more measured properties taken into account when controlling the timing of a said variably timed valve associated with a first working chamber comprise at least one measured property of the function of a second working chamber of the fluid working machine. For example, a measured property of the function of any one working chamber which relates to a property of received working fluid (e.g. which relates to the temperature, pressure or entrained gas concentration of received working fluid) may be useful to determine the timing of the opening or closing of a variably timed valve associated with another working chamber which also received working fluid having the same properties.

The timing of the opening or closing of the variably timed valve may be altered, away from a calculated optimum time, to enable measurements to be taken to facilitate subsequent calculations as to the optimum time for the variable timed valve to be opened or closed during subsequent cycles. Thus, the method may comprise the step of varying the timing of the actively controlled opening or closing of the said low or high pressure valve, relative to cycles of working chamber volume, measuring one or more properties of the performance of the fluid working machine subsequently to each said actively controlled opening or closing during at least one earlier cycle of working chamber volume, storing data concerning the response of the said one or more properties responsive to said timing of actively controlled opening or closing, and taking into account the stored data when determining the timing of the opening or closing of the variable timing valve during the later cycle of working chamber volume.

Preferably, the pressure differential between the working chamber and the low pressure manifold into which the secondary low pressure port releases pressurised fluid exceeds the pressure differential against which the primary low pressure valve can open by a factor of at least 10, and typically at least 100 or at least 1,000.

The fluid working machine may be a motor, in which case it may be operable to carry out only motoring cycles. However, the fluid working machine may be operable to function as either a motor or a pump in different operating modes, in which case it will only carry out motoring cycles in circumstances where it is operating as a motor.

Where the working chamber is a piston-cylinder having a generally fixed end and a moving end (for example, in the case of a radial or axial piston machine), the primary low pressure valve is preferably provided at the fixed end of the cylinder, to minimise movement of the primary low pressure valve. The primary low pressure valve may be coaxial with the cylinder or extend radially from the cylinder at the fixed end of the cylinder. The high pressure valve is typically also provided at the fixed end of the cylinder, typically either coaxially with or extending radially from the low pressure valve. In these arrangements, the secondary low pressure port is preferably provided at the opposite end of the cylinder. This has the advantage of causing an exchange of fluid in all parts of the cylinder on each cycle, reducing hot spots in the fluid around the base of the cylinder. For example, the secondary low pressure port may be coaxial with or extend radially from the cylinder, at the moving end of the cylinder.

The controller is operable to control the opening and/or closing of the primary low pressure valve. Where the high pressure valve comprises an electronically controllable valve, the controller is preferably operable to control the opening and/or closing of the said electronically controllable valve.

The controller is preferably operable to control the opening and/or closing of the at least one electronically controllable valve (comprising at least the primary low pressure valve) on a cycle by cycle basis by either, or preferably both, of determining whether or not to open and/or close a specific electronically controllable valve during a specific cycle, and determining the phase of the opening and/or closing of a specific electronically controllable valve relative to a cycle of the volume of the working chamber. By controlling the opening and/or closing of the at least one electronically controllable valve we include the possibility of holding a valve open or closed.

Typically, by controlling the opening and/or closing phase of the at least one electronically controllable valve (comprising at least the primary low pressure valve) on a cycle by cycle basis, the controller is operable to cause the working chamber to displace a volume of fluid selected from a plurality of different selectable volumes, on a cycle by cycle basis. Typically, the plurality of different selectable volumes includes the maximum volume displaceable by an individual working chamber, and no net displacement. No net displacement may be achieved by an idle cycle in which the electronically controllable low pressure valve remains open throughout a cycle of working chamber volume or by sealing the working chamber throughout a cycle of working chamber volume, for example as described in WO 2007/088380. By displacement we refer to the net movement of fluid from the or each low pressure manifold to the (or each) high pressure manifold, or vice versa, and do not refer to any net movement of fluid between low pressure manifolds, or high pressure manifolds, which may occur. The plurality of different selectable volumes preferably also includes at least one volume, and preferably a plurality of volumes (for example, a continuous range of volumes) between no net displacement and the maximum volume displaceable by the working chamber. However, where a plurality of working chambers are provided, the controller may also control groups of working chambers in this manner. The controller typically balances the time averaged net throughput of fluid of one or more working chambers against a received demand signal which may be constant or variable. The fluid working machine may be used in combination with high and/or low pressure accumulators in communication with the high and/or low pressure manifolds respectively to smooth the pressure or flow of the input and/or output fluid.

Typically, towards the lower end of an operating range of flow rates the controller is operable to intersperse idle cycles in which there is no net displacement of fluid and partial cycles in which a part of the maximum stroke volume of the working chamber is displaced, even where a demand signal remains constant. Typically, within a portion of the operating range of flow rates the controller is operable to intersperse idle cycles in which there is no net displacement of fluid and partial cycles in which a part of the maximum stroke volume of the working chamber is displaced, and full cycles in which the maximum stroke volume of the working chamber is displaced, even where a demand signal remains constant.

The one or more electronically controllable valves (including the electronically controllable primary low pressure valve, and the high pressure valve and/or the secondary electronically controllable valve where provided) are typically face-sealing valves. The one or more electronically controllable valves (including the electronically controllable primary low pressure valve, and the high pressure valve and/or the secondary electronically controllable valve where provided) are typically poppet valves. The one or more electronically controllable valves (including the electronically controllable primary low pressure valve, and the electronically controllable high pressure valve and/or the secondary electronically controllable valve where provided) may be electromagnetically actuated poppet valves. The one or more electronically controllable valves (including the electronically controllable primary low pressure valve, and the electronically controllable high pressure valve and/or the secondary electronically controllable valve where provided) may be solenoid operated poppet valves.

The low pressure valve is typically inward opening, toward the working chamber. The high pressure valve is typically outward opening, away from the working chamber.

In embodiments in which the fluid working machine comprises a plurality of said working chambers, the optional and preferred features discussed herein typically apply to each said working chamber and the primary low pressure valve and, where relevant, high pressure valve associated with each said working chamber, as appropriate. Typically, the or each low and high pressure manifold is in communication with more than one (for example, each) of the plurality of said working chambers.

The method may comprise opening an electronically controllable primary low pressure valve, during a motoring cycle of the working chamber, in phased relation to cycles of working chamber volume, to bring the working chamber into fluid communication with a low pressure manifold under the active control of a controller on a cycle by cycle basis, and further comprise releasing pressure within the working chamber prior to the opening of the primary low pressure valve, during the expansion stroke of a said motoring cycle. Pressure may be released through a secondary low pressure port. The secondary low pressure port is opened by a mechanical arrangement which is operatively linked to cycles of working chamber volume. Typically, the fluid working machine comprises a rotatable shaft, and the opening of the secondary low pressure port is mechanically linked to the rotatable shaft.

The invention extends in a third aspect to computer software comprising program code which, when executed on a fluid working machine controller, causes the controller to carry out the method of the first aspect. The invention also extends to computer software comprising program code which, when executed on a computer, causes the computer to simulate the operating of a fluid working machine having a low or high pressure valve the opening or closing of which is actively controlled by the method of any one of claims 1 to 16. The computer software is typically stored in or on a computer readable data storage medium.

According to a fourth aspect of the invention there is provided a method of measuring a property of entrained gas in a hydraulic liquid received by a working chamber of a fluid working motor, wherein the said property is determined from the period of time elapsing between the closure of a first valve to isolate the working chamber and the passive opening of a second valve to bring the working chamber into fluid communication with a manifold. Typically, the second valve is operable to open against a pressure differential (which may be a predetermined pressure differential).

The said property may be related to the compressibility or bulk modulus of the received hydraulic fluid. The said property may be related to concentration or presence of entrained gas (for example, whether entrained gas is present, or present in an amount having an effect exceeding a threshold).

The said property typically is, or is related to, the concentration of entrained gas in the received hydraulic liquid. However, the property may for example be a property concerning the rate of pressure changing in a sealed working chamber which is related to the concentration (and also composition) of entrained gas sealed within the working chamber.

The second valve may be operable to open passively when the pressure differential across the second valve drops below the predetermined pressure differential. The second valve may be actively controlled to determine whether the second valve opens, but not operable to open until the pressure differential across the second valve drops below the predetermined pressure differential. For example, the second valve may be an electronically actuatable pilot operated valve including a pilot valve which is openable against a substantial pressure differential to facilitate the opening of a main valve when the pressure differential drops below a predetermined amount. The predetermined pressure differential typically depends on the forces exerted on a valve member by biasing means (typically one or more springs or other elastic members).

In a fifth aspect, the invention extends to a fluid working machine comprising a working chamber of cyclically varying volume, a low pressure manifold and a high pressure manifold, a low pressure valve for regulating communication between the low pressure manifold and the working chamber, an electronically controlled high pressure valve for regulating communication between the high pressure manifold and the working chamber, and a controller operable to actively control at least one of the low pressure valve and the high pressure valve to determine the net displacement of fluid by the working chamber on a cycle by cycle basis characterised by entrained gas measurement means to measure entrained gas within working fluid received into the working chamber, the controller being operable to take into account measured entrained gas when determining the timing of the active opening or closure of at least one of the low pressure valve and the high pressure valve.

The entrained gas measurement means determines a parameter related to entrained gas within the working fluid from the period of time elapsing between the closure of a first valve to isolate the working chamber and the passive opening of a second valve to bring the working chamber into fluid communication with a manifold, wherein the second valve is operable to open against a predetermined pressure differential.

The invention also extends to computer software comprising program code (typically on or in a computer readable storage medium) which, when executed on a fluid working machine controller, causes the fluid working machine to determine the timing of the active opening or closure of one or more actively controlled valves taking into account received measurements of entrained gas.

According to a sixth aspect of the present invention there is provided a method of modelling the function of a fluid working machine comprising a working chamber of cyclically varying volume, a low pressure manifold and a high pressure manifold, a low pressure valve for regulating communication between the low pressure manifold and the working chamber, an electronically controlled high pressure valve for regulating communication between the high pressure manifold and the working chamber, and a controller operable to actively control at least closure of the high pressure valve and closure of the low pressure valve to determine the net displacement of fluid by the working chamber on a cycle by cycle basis, characterised in that the method comprises taking into account properties of entrained gas in fluid received into the working chamber from the high pressure manifold.

The invention also extends in a seventh aspect to a method of designing, simulating, calibrating or operating a fluid working machine comprising modelling the function of the fluid working machine by a method according to the sixth aspect of the invention.

The invention also extends in an eighth aspect to a method of calibrating or operating a fluid working machine comprising measuring one or more properties of entrained gas in fluid received into a working chamber of the fluid working machine and modelling the function of the fluid working machine by the method of the sixth aspect of the invention, wherein the properties of entrained gas which are taken into account comprise the measured one or more properties of entrained gas.

According to a ninth aspect of the invention there is provided a method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, a pressure sensor for measuring a sensed pressure of fluid in the high pressure manifold, and a controller which actively controls one or more said valves to determine the net displacement of working fluid by the working chamber on a cycle by cycle basis and operable to receive the sensed pressure, at least one of the low pressure valve and the high pressure valve being a variably timed valve, the timing of the opening or closing of which is varied relative to cycles of working chamber volume according to a calibration function relating the timing of the opening or closing relative to cycles of working chamber volume to the sensed pressure, characterised by the controller modifying the calibration function responsive to an additional parameter which varies in use.

Thus, the calibration function (which relates the timing of the opening or closing relative to cycles of working chamber volume to the sensed pressure) can be modified in response to an additional parameter, or more than one additional parameters. By an additional parameter we refer to a parameter other than sensed pressure.

The timing of the opening or closing of the variably timed valve can therefore be controlled taking into account not only the instantaneous sensed pressure but also at least one additional parameter which varies in use. This enables the opening or the closing of the variably timed valve to be actuated closer to the point at which the opening or closing might fail, or might cause another valve to fail to open or close (typically passively). For example, it might enable the closure of the low pressure valve in a pumping cycle to be delayed further than would otherwise be the case, while still ensuring that the low pressure valve closes in time to enable the high pressure valve to open. Otherwise, it would be necessary to close the low pressure valve at an earlier time in order to ensure that the high pressure valve opens and thereby avoid failure. Furthermore, it can allow the volume of fluid displaced during each cycle to be more accurately specified than would otherwise be the case if there was variation in the precise timing of the opening or closing of the variably timed valve due to additional parameters which vary in use.

The calibration function may be modified by calculating a new calibration function. The calibration function may be modified by loading an alternative calibration function from a memory. The calibration function may be modified by combining more than one calibration function in an alternative way, or by changing the scale of a calibration function (including changing the scale of an input or output of the function, and including a non-linear scaling).

The sensed pressure may be measured on or near the fluid working machine, or may be measured remote to the fluid working machine, for example in the fluid working system fluidically connected thereto.

The net displacement of fluid occurs between the high and low pressure manifolds, either from the low pressure to the high pressure manifold in the case of a pumping cycle, or vice versa in the case of a motoring cycle.

It may be that the variably timed valve is the low pressure valve, and the calibration function relates the sensed pressure to the timing of the closing of the low pressure valve during a pumping or motoring cycle of the fluid working machine such that the low pressure valve closes at the correct time for the working chamber to displace a desired net volume of working fluid (from the low pressure manifold to the high pressure manifold via the working chamber). This may be especially useful where the pumping or motoring cycle is a part stroke cycle which displaces only a part of the maximum stroke volume of the respective working chamber.

It may be that the variably timed valve is the high pressure valve, and the calibration function relates the sensed pressure to the timing of the closing of the high pressure valve during a motoring cycle of the fluid working machine such that the high pressure valve closes at the correct time for the working chamber to displace a desired net volume of working fluid.

It may be that the variably timed valve is the low pressure valve, and the calibration function relates the sensed pressure to the timing of the closing of the low pressure valve during a motoring cycle of the fluid working machine to ensure that the low pressure valve closes sufficiently far before Top Dead Centre (TDC) to equalise the pressure between the working chamber and the high pressure manifold (so that the high pressure valve may be opened to admit working fluid into the working chamber from the high pressure manifold on the subsequent intake stroke of the working chamber), but not so far before TDC that the working chamber emits a significant amount of working fluid to the high pressure manifold (before TDC), for example, it may be not so far before the TDC that the working chamber emits 0.5 cc or 1 cc; or 3%, 5% or 10% of the swept volume of the working chamber.

It may be that the variably timed valve is the high pressure valve, and the calibration function relates the sensed pressure to the timing of the closing of the high pressure valve during a motoring cycle of the fluid working machine to ensure that the high pressure valve closes sufficiently far before Bottom Dead Centre (BDC) to equalise the pressure between the working chamber and the low pressure manifold (so that the low pressure valve may be opened to admit working fluid from the working chamber to the low pressure manifold on the subsequent exhaust stroke of the working chamber), but not to too far before BDC that the working chamber fails to admit a significant amount of working fluid from the high pressure manifold (before BDC), for example, it may be not so far before the BDC that the working chamber fails to admit 1 cc or 2 cc; or 5%, 10% or 15% of the swept volume of the working chamber.

The additional parameter may be a measurement of one or more properties of the working fluid. The or a said property of the working fluid may be the temperature of the working fluid. The or a said property of the working fluid may be a measurement related to the compressibility of the working fluid. The measurement related to the compressibility of the working fluid may be determined accounting for entrained gas in the working fluid. Typically, the additional parameter is a parameter other than the frequency of cycles of working chamber volume.

Generally it is difficult or expensive to measure the compressibility of the working fluid directly. It may be that the compressibility of the working fluid is derived from a measurement of a property of the operation of the fluid working machine or system.

Thus, it may be that the additional parameter is derived from a measurement of a property of the operation of the fluid working machine.

The calibration function may be varied responsive to whether the actual time-averaged net displacement of fluid by the working chamber is substantially the same as an intended time-averaged net displacement of fluid by the working chamber caused by the activation of the variably timed valves relative to cycles of working chamber volume. It may be that whether the actual and intended time-averaged net displacements of fluid are substantially the same is determined responsive to the sensed pressure (and typically also the active control one or more said valves by the controller, and a model of a fluid system connected to the high pressure manifold).

The measurement of a property of the operation of the fluid working machine may be a measurement of one or more properties of the passive (i.e. not active under the direct control of the controller) opening of one or more valves, for example, the time between a first valve associated with a working chamber closing and a second valve associated with a working chamber opening. Properties include the speed, acceleration and timing (e.g. phase relative to cycles of working chamber volume) of opening of the one or more valves.

It may be that the measurement of a property of the operation of the fluid working machine is a measurement of the rate of change of sensed pressure responsive to the net displacement of fluid by a working chamber.

The rate of change of sensed pressure may be measured over a single net displacement of fluid by the working chamber, or a plurality of displacements by one or more working chambers. The rate of change of sensed pressure is a function of the properties, particularly the compressibility, of the working fluid, and so the properties, and therefore the calibration function, can be calculated from the rate of change.

Typically, the fluid working machine comprises a shaft sensor for determining the angular position of a rotatable shaft operably linked to the cycles of working chamber volume, and the controller is operable to receive a measurement of shaft angle from the shaft sensor. The calibration function may determine one or more of an angle component and a time offset component of timing measured relative to the rotation of the rotatable shaft (such that the additional parameter changes the angle of opening or closing of the variably timed valves).

Typically, the fluid working machine comprises a memory in communication with the controller, which stores data used by the controller, for example, to define or calculate the calibration function.

It may be that the controller calculates one or more further parameters with reference to the stored data and current operating conditions of the fluid working machine, and combines the further parameters with the calibration function to determine the timing of the opening or closing of the variably timed valves relative to cycles of working chamber volume.

Further parameters include: parameters that vary with the rotation speed of a rotatable shaft operably linked to the cycles of working chamber volume; parameters that vary with a selectable operating mode; parameters responsive to the characteristics (including characteristics that change in use) of the variably timed valves, and; parameters that do not vary in use.

It may be that the opening or closing of the variably timed valves occurs a time delay after a (activation or deactivation) signal to the variably timed valves, wherein the controller calculates the time delay from the further parameters and controls the timing of the opening or closing of the variably timed valves by the timing of the (activation or deactivation) signal taking into account the time delay.

The calibration function may be modified responsive to both one or more additional parameter and the stored data. The said stored data may comprise a plurality of stored calibration functions and it may be that the controller selects a stored calibration function or functions in use responsive to the additional parameter.

The stored data may comprise one or more calibration function parameters and it may be that the controller determines the calibration function from the calibration function parameters and the additional parameters.

The invention extends in a tenth aspect to a process of manufacturing a fluid working machine operable according to the method of the ninth aspect of the invention, comprising assembling the fluid working machine, testing the fluid working machine, optimising the performance of the fluid working machine and storing values obtained from said optimisation in the stored data.

The invention extends in an eleventh aspect to a process of manufacturing a fluid working machine operable according to the method of the ninth aspect of the invention, comprising assembling the fluid working machine, carrying out a computer simulation of the operation of the fluid working machine (in either order) and storing values obtained from the computer simulation in the stored data.

The experimental optimisation and computer simulation processes may comprise varying the properties of the working fluid such that the additional parameter varies, adjusting the timing of the opening and closing of the variably timed valves, measuring the operation of the fluid working machine, and recording the timing values and the additional parameter, when the operation of the fluid working machine is optimised, into the stored data. The experimental optimisation may be carried out for each fluid working machine, or for each materially different design of fluid working machine. Typically, there is more than one said additional parameter. Typically, the optimisation is such that the net displacement of fluid from a low pressure to a high pressure manifold or vice versa, is maximised, for the full range of expected operating conditions which are not measured by the additional parameters.

According to a twelfth aspect of the present invention there is provided computer software comprising program instructions which, when executed on a computing device, cause the computing device to model the function of a fluid working machine, simulate the function of a fluid working machine, calibrate a fluid working machine, or control the function of a fluid working machine by a method according to the sixth, seventh, eighth or ninth aspect of the invention.

The computer software discussed above is typically stored on or in a carrier, such as a computer readable medium. The program code may take the form of source code, object code, a code intermediate source, such as in partially compiled form, or any other form suitable for use in the implementation of the methods of the invention. The program code may be stored on or in a carrier, which is typically a computer readable carrier such as a ROM, for example a CD ROM or a semiconductor ROM, or a magnetic recording medium, for example a floppy disc or hard disc. Furthermore, the carrier may be a transmissible carrier such as an electrical or optical signal which may be conveyed via electrical or optical cable or by radio or other means. When a program is embodied in a signal which may be conveyed directly by cable, the carrier may be constituted by such cable or other device or means.

Optional features mentioned above in respect of any aspect of the application are optional features of each aspect of the application.

DESCRIPTION OF THE DRAWINGS

An example embodiment of the present invention will now be illustrated with reference to the following Figures in which.

DETAILED DESCRIPTION OF AN EXAMPLE EMBODIMENT

Figure 1:
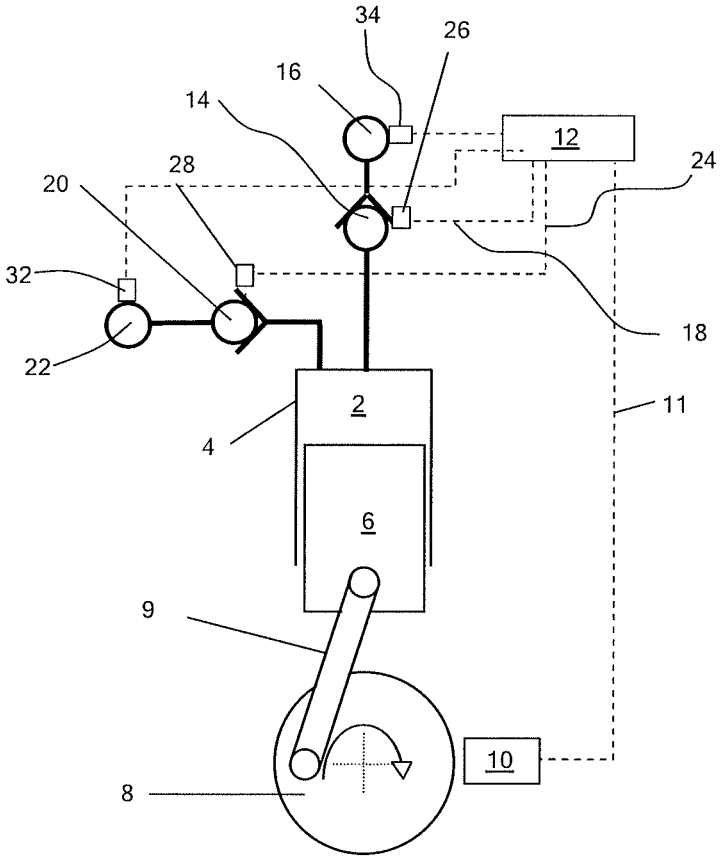
FIG. 1 is a schematic diagram of an individual working chamber of a fluid working machine.

In a first example, a fluid working machine in the form of a hydraulic pump includes a plurality of working chambers. FIG. 1 illustrates an individual working chamber 2 which has a volume defined by the interior surface of a cylinder 4 and a piston 6 which is driven from a crankshaft 8 by a crank mechanism 9 and which reciprocates within the cylinder to cyclically vary the volume of the working chamber. A shaft position and speed sensor 10 determines the instantaneous angular position and speed of rotation of the shaft, and informs a controller 12, by way of electrical connection 11, which enables the controller to determine the instantaneous phase of the cycles of each individual working chamber. The controller is typically a microprocessor or microcontroller which executes a stored program in use.

The working chamber comprises a low pressure valve (LPV) in the form of an electronically actuatable face-sealing poppet valve 14, which faces inwards toward the working chamber and is operable to selectively seal off a channel extending from the working chamber to a low pressure manifold 16, which functions generally as a net source or sink of fluid in use. The LPV is a normally open solenoid closed valve which opens passively when the pressure within the working chamber is less than the pressure within the low pressure manifold, during an intake stroke, to bring the working chamber into fluid communication with the first low pressure manifold, but is selectively closable under the active control of the controller via a LPV control line 18 to bring the working chamber out of fluid communication with the low pressure manifold. Alternative electronically controllable valves may be employed, such as normally closed solenoid opened valves.

The working chamber further comprises a high pressure valve (HPV) 20 in the form of a pressure actuated delivery valve. The HPV faces outwards from the working chamber and is operable to seal off a channel extending from the working chamber to a high pressure manifold 22, which functions as a net source or sink of fluid in use. The HPV functions as a normally-closed pressuring-opening check valve which opens passively when the pressure within the working chamber exceeds the pressure within the high pressure manifold. The HPV may also function as a normally-closed solenoid opened check valve which the controller may selectively hold open via a HPV control line 24 once the HPV is opened by pressure within the working chamber. Alternatively, the HPV may be openable under the control of the controller when there is pressure in the high pressure manifold but not in the working chamber, or may be partially openable, for example only a portion of the HPV may be openable against a pressure difference, with the remaining portion openable when the pressure difference reduces.

The LPV and HPV have LPV 26 and HPV 28 valve monitoring devices respectively which can detect opening, closing or speed of movement of the LPV and HPV, and communicate this information to the controller. In this example, the valve monitoring devices are incorporated into the valves themselves. The low and high pressure manifolds have low pressure 30 and high pressure 32 pressure transducers which communicate sensed pressure in their respective manifolds to the controller. The controller is operable to observe the character and timing of all these signals relative to the timing and character of its commands to the LPV and/or HPV and also the shaft position and speed (and hence the working chamber volume and rate of change of volume).

Importantly, as well as determining whether or not to close or hold open the primary low pressure valve on a cycle by cycle basis in the manner known from, for example, EP 0 361 927, EP 0 494 236, and EP 1 537 333, the controller is operable to vary the precise phasing of the closing of the LPV and HPV with respect to the varying working chamber volume during cycles which it has been determined that the LPV and HPV should close.

Figure 2:
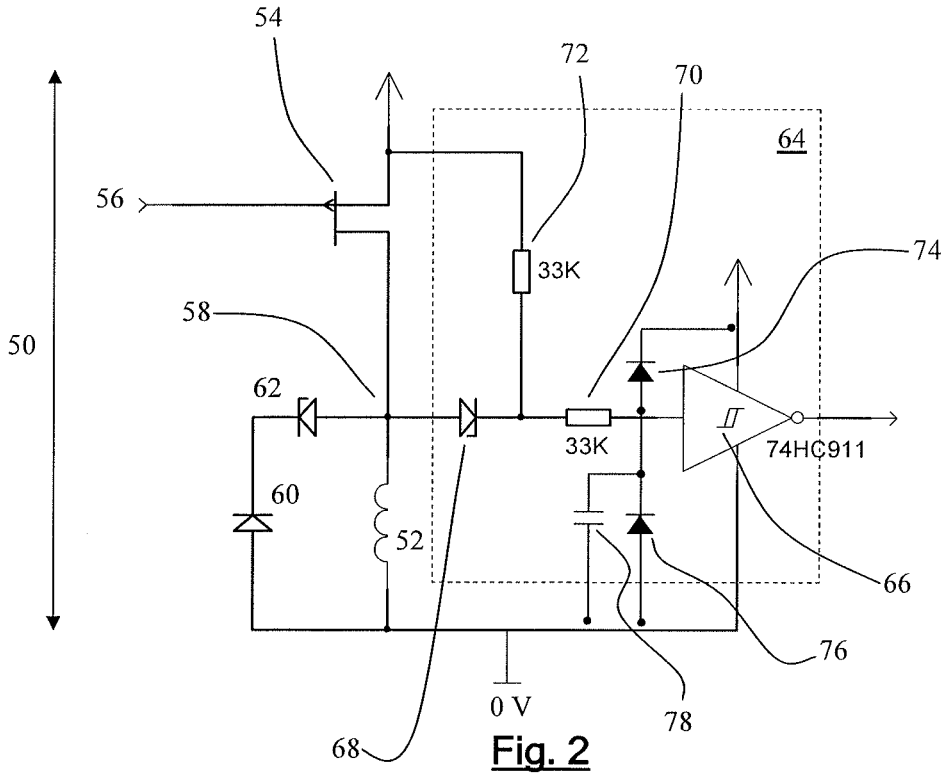
FIG. 2 is a schematic diagram of a valve monitoring electrical circuit.

FIG. 2 is a circuit diagram of a valve monitoring device for monitoring an actuated valve comprising an electromagnetic coil, in this example also incorporating an amplifier for driving more current into the coil than the controller would otherwise be capable of supplying. 12V power supply 50 is connected across coil 52 via a P-channel FET 54 (acting as the amplifier), the FET being under the control of the controller 12 (FIG. 1) via an interface circuit (not shown) connected at 56 and also connected to a sensed junction 58. A flywheel diode 60 and optional current-damping zener diode 62 in series provide a parallel current path around the coil. A valve monitoring circuit is shown generally at 64 and comprises an inverting Schmitt trigger buffer 66 driven by a level shifting zener 68 connected to the coil and FET node and biased by bias resistor 72, protected by protection resistor 70. The Schmitt trigger output signal is referenced to supply rails suitable for connection to the controller, and diodes 74, 76 (which may be internal to the Schmitt trigger device) protect the Schmitt trigger. An optional capacitor 78 between the Schmitt trigger input and the protection resistor acts (in conjunction with the protection resistor) as a low pass filter, and is useful in the event that noise (for example PWM noise) is expected.

In operation, the sensed junction sits at 0V and the bias resistor draws the Schmitt trigger's input to the level-shifting zener diode's value of 3V, driving the Schmitt trigger's output low. When the controller activates the FET to close or open the associated valve the sensed junction is at 12V, but the protection resistor protects the Schmitt trigger from damage and its output is still low. When the controller removes the activating signal, the sensed junction voltage falls to around −21V due to the flywheel diode and current-clamping zener diode and the inductive property of the coil. The protection resistor protects the Schmitt trigger from the −18V signal it will see after the level-shifting zener, but the Schmitt trigger now outputs a high signal. After the inductive energy dissipates, the Schmitt trigger output returns to a low value. However, if the valve begins to move, for example because it is no longer held closed by pressure, then the motion will produce through inductive effects a voltage across the coil, and hence a negative voltage at the sensed junction. The Schmitt trigger produces a high output which the controller can detect and/or measure, thus to detect the time, speed or presence of valve movement. The inductive voltage generated by the coil may be due to some permanent magnetism of the valve materials or some residual current circulating in the coil due to bias resistor 72.

It will be appreciated that valve monitoring devices could be implemented in numerous ways and that, although in this example the valve monitoring device is integral to the valve, it may be physically separate to the valve and in wired communication with the valve solenoid. Other mechanisms of detecting the valve movement will present themselves to those skilled in the art, for example applying an exciting AC signal or pulses to the coil and detecting the change in inductance of the coil 52 as the valve moves, or incorporating a series or parallel capacitor to create an LC circuit the resonant frequency and Q factor of which change with valve position.

The controller may need to disregard some high or low signals that it receives (or fails to receive, when expected) from the sensor. For example, voltage changes on either end of the coil 52 can cause false readings, including detecting valve movement when none has occurred and failing to detect valve movement when it has occurred. The controller therefore is preferably operable to selectively disregard signals which are received at unexpected times, or which are correlated with other events known to interfere with the correct and accurate measurement of valve movement. For example, the activation of other coils of a fluid working machine sharing a common 0V line with the coil 52 can raise the voltage at sensed junction 58. Thus, if the other coil is activated simultaneous to the movement of coil 52, the sensor may fail to detect the movement of coil 52 since the voltage at sensed junction 58 will not drop sufficiently low.

Figure 3:
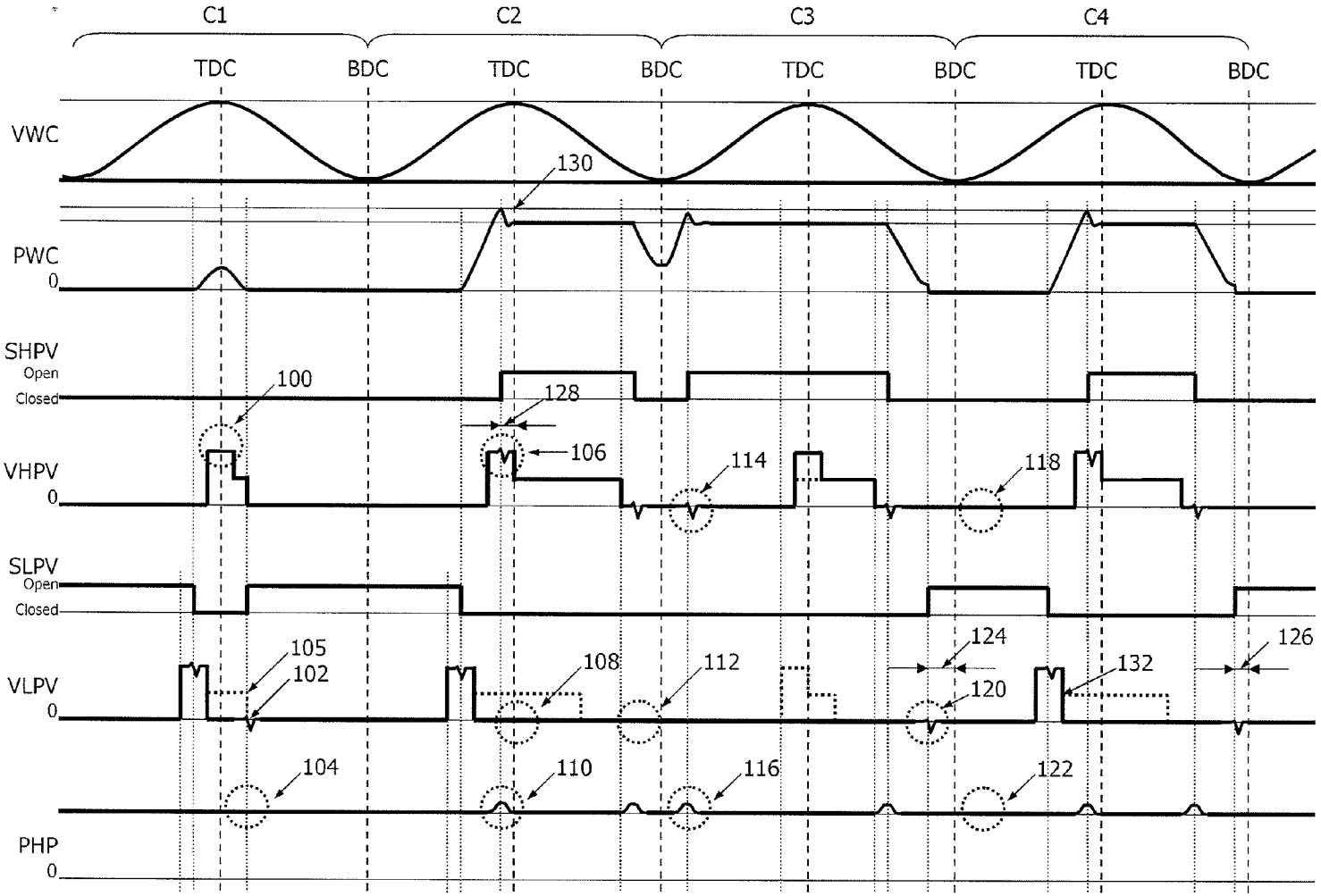
FIG. 3 is a timing diagram illustrating the status of the Low Pressure Valve (LPV), the High Pressure Valve (HPV), as well as the pressure within a working chamber during a series of motoring cycles.

FIG. 3 is a timing diagram illustrating the piston 6 position relative to the cylinder 4 VWC which is equivalent to the working chamber volume, the states SLPV and SHPV (open or closed) of the LPV 14 and HPV 20 respectively, as well as the pressure within the working chamber (PWC) during a sequence of cycles of the fluid working machine working chamber shown in FIG. 1. The voltages VLPV and VHPV at the sensed junction 58 of the LPV and HPV respectively are also shown, while trace PHP shows the pressure measured by high pressure manifold pressure transducer 32.

At time t1 in the earlier cycle C1, late in the exhaust stroke of the working chamber (i.e. the piston 6 is close to and approaching Top Dead Centre (TDC)), the controller activates the LPV coil (see trace VLPV) to begin a motoring cycle, the decision to do so being made according to any of the algorithms disclosed in any of the prior art documents which are hereby incorporated by reference. A short time later the LPV closes (see trace SLPV) and working chamber pressure PWC builds, while the controller activates the HPV (trace VHPV) to hold it open. However, PWC does not reach the pressure PHP of the high pressure manifold so the HPV valve cannot open (see trace SHPV), and PWC falls after TDC.

The controller may detect that the HPV has not opened by noticing the lack of an event in region 100, or it might detect the LPV reopening 102 at t3 because it was not held closed by working chamber pressure, or it might detect the absence of a pressure pulse in PHP at 104 (which act as properties of the performance of the fluid working machine during an earlier cycle). If the second fluid working machine 201 is pressure compensated, the controller may detect the failure by a reduction in the displacement or flow of the fluid working machine 201, or if the second fluid working machine 201 is flow-controlled the pressure PHP may step up at time t10, leading to detection of the failure. The controller may detect that the HPV has not opened by a shaft torque measurement on either fluid working machine. Accordingly at t3 the controller turns off the HPV to save power and adjusts its preferred timing for closing the LPV in later cycles. The dashed line in trace VLPV represents the possibility that the controller may activate only partially (for example by pulse width modulation, PWM) the LPV, for example to hold it closed to give time for pressure to build or if the LPV's opening spring is strong enough to open it in use despite pressure in the working chamber. This technique may be used in any of the cycles.

At time t5 in the later cycle C2 the controller activates the LPV slightly earlier in phase than in the earlier cycle C1. This time PWC successfully builds and the HPV opens at t7. The controller can verify this by detecting the HPV opening event at 106, the lack of LPV opening event at 108, or the pressure pulse at 110 (caused by the sudden outflow of fluid into the high pressure manifold interacting with the inertia of fluid already there), for example. The controller may choose to now partially activate the HPV as shown (for example by PWM) to save power while maintaining the valve in its open position. Near the end of the intake stroke at t9 the controller deactivates the HPV which closes a short time later and thus initiates a fall in PWC. However, PWC falls insufficiently by the point of maximum working chamber volume at Bottom Dead Centre (BDC), so the LPV remains held closed by the working chamber pressure. The controller may detect this failure to open by the absence of an opening signal 112, or by the presence of HPV reopening 114, or by the PHP pulse 116 caused by fluid being returned from the working chamber to the high pressure manifold. If the second fluid working machine 201 is pressure compensated, the controller may detect the failure by a reduction in the displacement or flow of the fluid working machine 201, or if the second fluid working machine 201 is flow-controlled the pressure PHP may step up at time t10, leading to detection of the failure. The controller may detect that the LPV has not opened by a shaft torque measurement on either fluid working machine. Accordingly the controller adjusts its preferred timing for closing the HPV, in later cycles, to be earlier in phase than in this earlier cycle.

At time t11 in cycle C3 the controller may activate the LPV (dashed lines) to initiate another motoring cycle—however this is optional as the LPV is already closed. A short time later it can activate the HPV as before to begin a motoring cycle. It may only need to partially activate the HPV, as shown, because it will already be open. At t13 the controller deactivates the HPV a little earlier than in the earlier cycle C2 and PWC falls sufficiently for the LPV to reopen at t15.

The controller may detect that the LPV has opened by noticing the lack of an event in region 118, or it might detect the LPV reopening 120 because it was not held closed by working chamber pressure, or it might detect the absence of a pressure pulse in PHP at 122.

The above examples show how the invention can cause a fluid working machine to adjust its valve timing to achieve correct operation, from a situation where the parameters cause it to fail to operate correctly. However, the invention is particularly advantageous when the controller measures the phase (being one way of representing time relative to cycles of working chamber volume) of events compared to the working chamber volume reported by the shaft position sensor 10 in an earlier cycle, or measures the length or rate of change of the electrical signals associated therewith, to determine how it should adjust the timing or phase of a valve change in a later cycle. In this way the controller can continuously adjust and improve the timing of valve events under its control to ensure the optimal fluid flow through the fluid working machine, but without ever failing to complete a desired operating cycle.

By way of a specific example, the controller measures the elapsed time 124 between LPV opening and BDC in cycle C3, acting as the earlier cycle, and finds it to be a longer period than a predetermined desired period. In a different embodiment, the controller measures the closing velocity of the valve using the strength of the LPV opening pulse 120, and finds it to be a faster velocity than a predetermined desired velocity which may depend on the shaft rotation speed. The faster velocity is a symptom of the valve opening when the working chamber is expanding and therefore the opening being too early. In yet another embodiment, the controller may measure the delay between the HPV deactivation at $t_{13}$ (or the time of HPV closing) and the LPV reopening pulse 120, and finds it to be a shorter delay than a predetermined desired delay which may depend on the shaft rotation speed and the working pressure. The shorter delay is a symptom of the HPV closing and LPV opening happening when the working chamber is expanding and therefore the closing being too early. In any case, in the final illustrated motoring cycle C4, acting as the later cycle, the HPV is deactivated at time t17, which is later in phase relative to BDC than t13 by a suitable function of the difference between the longer period and the desired period (or the faster velocity and the desired velocity, or the shorter delay and the desired delay), for example the controller may calculate the difference and apply a correction equal to 0.6 times this difference. Hence the elapsed time 126 in the later cycle is closer to the desired period, and the machine operates more quietly, more smoothly, or with increased longevity. The controller is able to adjust the timing to a safe, yet optimal, point near to failure, while avoiding a failure of any cycle. Therefore, in contrast to the example suggested by the cycles C1-C3, it may be advantageous for the controller to start its operation with very conservative (and therefore less optimal) timing of valve activation or deactivation, then to use performance data measured from one or more earlier cycles to inform the adjustment of timing for later cycles. In the case of a failure to pressurise (cycle C1) or a failure to depressurise (cycle C2) the controller may adjust the timing by some larger amount to ensure success of a subsequent cycle, for example by adding a large value to the correction. The controller may adjust the timing in this way on a continuous basis, to continuously locate the optimum timing.

The controller may also measure the elapsed time 128 between HPV opening and TDC or characteristics of the pressure pulse 130 (for example) and adjust the timing of the later LPV activation 132. This illustrates that it is also possible to use the method of the invention for pumping cycles.

Whereas an example has been described with respect to measuring pressure on the high pressure side of the fluid working machine, it is also possible to measure pressure on the low pressure side. Measurement on the low pressure side may be advantageous because the relative size of pressure pulses compared to the operating pressure should be larger on the low pressure side than the high pressure; however, fluid working systems are often not provided with low pressure sensors.

In this manner the invention allows a fluid working machine employing electronically controlled commutating valves and operating over a range of conditions or with component performance that varies over time, to operate reliably and efficiently.

In some embodiments, the controller may store the optimal timing of valve activation or deactivation in memory, including non-volatile memory. It may associate the timing data so stored only with certain conditions, for example certain temperatures or pressures, and may associate other similarly derived timing data with other conditions, for example to produce a map of different optimal timing data to use in different operating conditions as determined by sensors, for example temperature and pressure sensors. The controller may update the map over time by use of the present invention. The controller may have individual maps associated with different working chambers. The controller may, for example, refer to or create look-up tables indicating, for example, the relationship between the phase at which the HPV closes during a motoring cycle and the phase at which the LPV subsequently opens, for a range of different temperatures, pressures and/or entrained gas concentrations.

Surprisingly, we have found that a substantial cause of variation in fluid working machine performance arises from entrained gas (typically air) dissolved in working fluid. The presence of entrained gas affects the rate of change of pressure with working chamber volume when the working chamber is sealed from both the high and low pressure manifolds. We have found that this is of particular importance during an expansion stroke, for example, during a motoring cycle, after closure of the HPV the pressure within the sealed working chamber falls. Although it is possible to provide a LPV which will open against a substantial pressure difference, such valves consume a substantial amount of energy and it is preferable to employ a LPV which opens passively, or with minimal energy consumption. Accordingly, it is important that pressure within the sealed working chamber falls rapidly to facilitate opening of the LPV. Entrained gas evaporates during expansion and substantially slows the reduction of pressure within the working chamber before the opening of the LPV (or in some embodiments, a secondary port which opens before the LPV to further reduce pressure and facilitate LPV opening). This effect varies critically depending on entrained gas composition and concentration, temperature and pressure.

Thus, in some embodiments, the effect of entrained gas deduced either by measuring the time of opening of the LPV or by measuring the variation with time of pressure within the working chamber using a working chamber pressure sensor. From this period of time, or the variation with time of pressure within the working chamber, and possibly also inputs from further sensors such as temperature sensors, an estimate of entrained gas concentration and composition, or of a parameter concerning the effect of entrained gas on the rate of pressure drop can be estimated and used to control the timing of closure of the HPV during later cycles so that it closes just in time to enable the pressure to fall sufficiently low for the LPV to open. Measurements of entrained gas concentration and the properties of entrained gas can also be employed when designing, simulating and calibrating fluid working machines. Instead of measuring the effects of entrained gas indirectly, entrained gas might be measured using a gas sensor operable to measure one or more analyte gaseous species in received working fluid.

Figure 4:
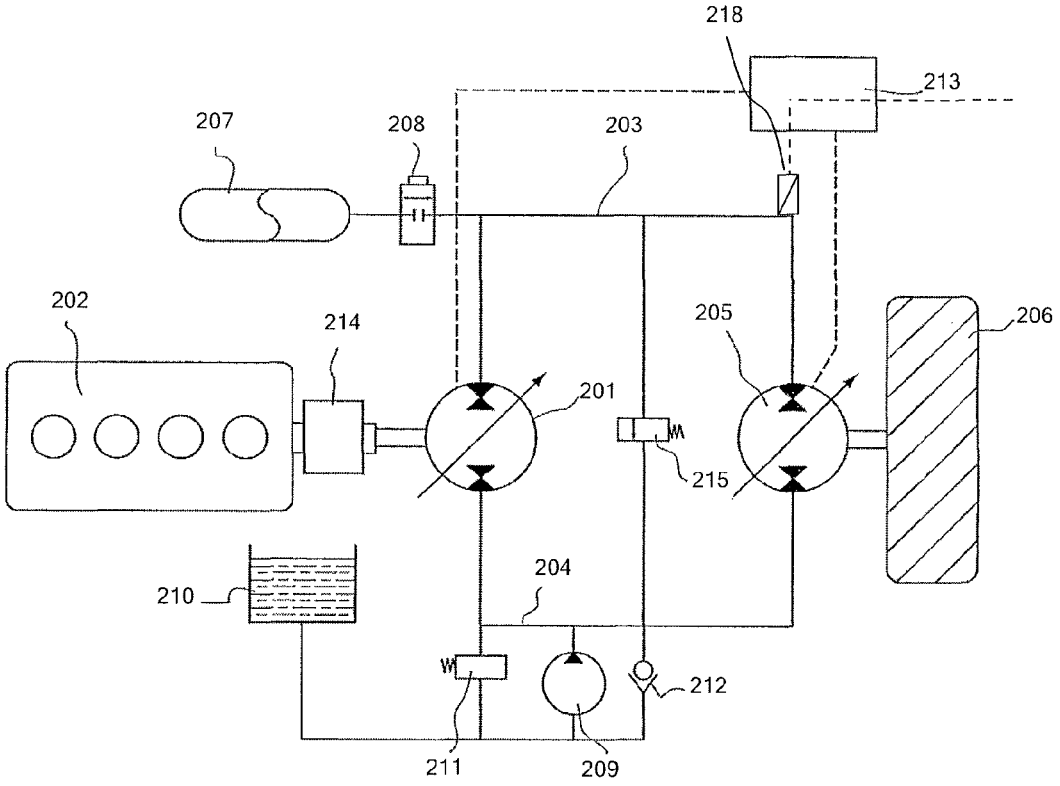
FIG. 4 is a schematic of a hybrid hydraulic transmission using the invention.

FIG. 4 shows a schematic of a hybrid hydraulic transmission using the invention. A first hydraulic pump/motor 201 of the type shown in FIG. 1 is driven by internal combustion engine 202 through a reduction gearset and/or clutch 214. The first pump/motor provides fluid to a high pressure line 203 feeding a second hydraulic pump/motor 205 also of the type described previously herein and driving at least one wheel 206. Fluid returns from (and in some modes, flows to) the second hydraulic motor via the low pressure line 204, which is raised slightly above atmospheric pressure by charge pump 209. A hydraulic accumulator 207 stores energy in the form of high pressure fluid, and is selectively connectable to the high pressure line by controllable blocking valve 208. A low pressure relief valve 211 returns fluid exhausted from the accumulator to reservoir 210, while check valve 212 admits fluid to the low pressure line from the reservoir if the net flow to the accumulator exceeds the capacity of the charge pump 209 in use. A controller 213 coordinates the two hydraulic pump/motors, the blocking valve 208, and reads a pressure sensor 218, amongst other inputs for example those from a driver (not shown).

There are several modes of use of the hybrid hydraulic transmission just described, which are known in the art. Many of these modes comprise one or other of the pump/motors operating in the motoring mode, in which it is known that the high pressure valve 20 may close too late for the low pressure valve 14 to open, causing torque fluctuations and other undesirable effects. Thus, the controller 213 uses the method of the invention to calculate or explicitly control the flow expected from each pump/motor and uses that expected flow to determine the expected pressure of the high pressure line 203, dependant on the compliance of the accumulator (if blocking valve 208 is open) and the high pressure line 203. The controller then compares the measured pressure from pressure sensor 218 (acting as a property of the performance of the fluid working machine during an earlier cycle of working chamber volume) to the expected pressure, and will advance the closing time of high pressure valves 20 in a subsequent cycle of working chamber volume if the measured pressure is significantly higher than the expected pressure. In this way the hybrid hydraulic transmission is able to optimise the timing of closing of the high pressure valves 20 in a continuous basis, in a way that adapts to the unpredictable properties of the working fluid. The controller may also determine that instead the low pressure valve 20 of the motoring machine is not sufficiently far advanced to pressurise the working chambers, and may advance the low pressure valve closing time.

Figure 5:
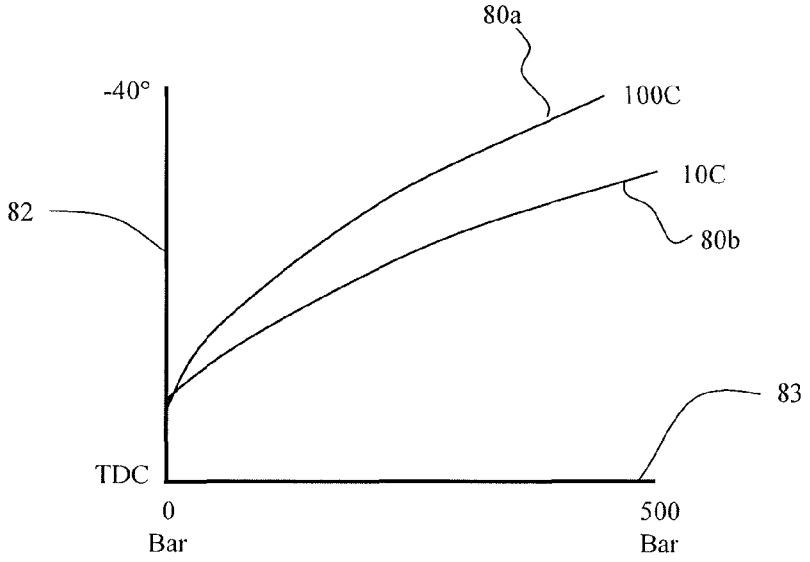
FIG. 5 is a representation of two possible calibration functions according to the invention.

In embodiments according to the ninth, tenth and eleventh aspects of the invention, the timing of the opening or closing of the variably timed valve is determined without necessarily referring to data measured during earlier cycles of working chamber volume. FIG. 5 shows a series of calibration functions 80*a*, 80*b* which relate the timing of the closing of the low pressure valve 82 (measured as phase in degrees before Top Dead Centre relative to cycles of working chamber volume. The angle of rotation of the shaft during each cycle of working chamber volume may be an integer fraction of the corresponding change in phase of the working chamber, for example, if each working chamber is driven by a multi-lobe cam) to instantaneous measured pressure in the high pressure manifold 83, each for a different working fluid temperature (80*a* for 100 C and 80*b* for 10 C). During each cycle of working chamber volume, a selected calibration function is evaluated, using a current measure of pressure in the high pressure manifold 22, thereby determining in whole or part the precise time (i.e phase relative to cycles of working chamber volume) at which the low pressure valve 14 is closed by the controller. (The controller may have to make other adjustments for the valve response time and other delays.) The controller senses the temperature of the working fluid at a convenient location (the working fluid is typically of more or less uniform temperature, and if not, the most appropriate temperature should be sensed, e.g. within the fluid working machine) and selects the most appropriate (e.g. closest) calibration function. In a preferred embodiment, the controller interpolates between the calibration functions 80*a*, 80*b* to obtain a more accurate calibration function for the current temperature.

The controller also determines which calibration function to use, and adjusts the calibration function in use, based on the measured performance of the fluid working machine. Thus, in the hybrid transmission of FIG. 4, having discovered the optimised timing of the closing of the high or low pressure valves, the controller may scale (for example, uniformly scale) the selected or interpolated calibration function of the pump/motors so that it matches the discovered optimised timing at the current pressure. This compensates for unpredictable changes in the fluid properties, for example air being entrained into the oil. In comparison to simply changing the timing to optimise performance, at the current operating pressure, adjusting the calibration function allows the pump/motor to operate optimally with the current fluid properties at different operating pressures it will encounter in the future. The controller may determine a scale factor and offset to apply to the selected or interpolated calibration function, and use that scale factor and offset to adjust a second selected or interpreted calibration function should the temperature change in the future.

The method just described is not limited of course to a hybrid vehicle, but could also be used for example to control the valves of any hydraulic motor (or even a pump) of the type described having electronically variable timing in any system with a pressure transducer. Alternatively, a flow transducer could be used.

The estimation of the correct timing in the above cannot be perfect due to measurement error and wear of the machine in use leading to an error band in the correct timing of the valves. The implications of failure of the motoring cycle, caused either by insufficient pressurisation or insufficient de-pressurisation, may be serious or safety-critical, whereas the implications of reduced volumetric displacement of the motoring cycle due to excessive pressurisation or excessive de-pressurisation will usually be much less serious. Therefore it is advantageous to bias the centre of the error band towards excessive pressurisation in the case of the LPV, and excessive de-pressurisation in the case of the HPV. This can simply be achieved by adding an offset to the calculated correct timing such that the valve event occurs slightly in advance of the correct time, taking into account the expected error margin, such that failure of the motoring cycle is unlikely given the expected error.

Further variations and modifications may be made within the scope of the invention herein disclosed.

The invention claimed is:

1. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, wherein the method comprises measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle, and monitoring a parameter concerning the opening or closing of at least one of the low pressure valve and the high pressure valve and at least one measured property concerns the opening or closing of a monitored valve.

2. A method according to claim 1, wherein the method is a method of actively controlling a motoring cycle of a fluid working machine and the variably timed valve is the high pressure valve.

3. A method according to claim 1, wherein the variably timed valve is the low pressure valve.

4. A method according to claim 1, wherein the variably timed valve is one of the said low pressure valve and the said high pressure valve and the monitored valve is the other of the said low pressure valve and the said high pressure valve.

5. A method according to claim 1, wherein the monitored valve is the variably timed valve.

6. A method according to claim 1, wherein one or more parameters concerning the opening or closing of the monitored valve comprise one or more of: whether the monitored valve opens during the earlier cycle of working chamber volume, whether the monitored valve closes during the earlier cycle of working chamber volume, when the monitored valve opens during the earlier cycle of working chamber volume, when the monitored valve closes during the earlier cycle of working chamber volume, the speed of opening of the monitored valve during the earlier cycle of working chamber volume, or the speed of closure of the monitored valve during the earlier cycle of working chamber volume.

7. A method according to claim 1, wherein one or more parameters concerning the opening or closing of the monitored valve are determined from one or more of the pressure in the low pressure manifold, the pressure in the high pressure manifold, the pressure in the working chamber, the torque of a shaft mechanically linked to cycles of working chamber volume, or changes therein.

8. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, wherein the method comprises measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle, wherein the variably timed valve is one of the low pressure valve and the high pressure valve and the method comprises monitoring one or more events which occur during the earlier cycle of working chamber volume after the controller instigates closure of the other of the low pressure valve and the high pressure valve and before the opening of the variably timed valve is completed.

9. A method according to claim 8, wherein the one or more measured properties comprise the rate of change of pressure within the working chamber at one or more times after the closure of the said other valve and before subsequent opening of the variably timed valve.

10. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, wherein the method comprises measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle, wherein the time required for said variably timed valve to open or close is taken into account when determining when the controller sends, stops sending, or changes the signal, as appropriate, to thereby control the timing of the opening or closing of a said variable timed valve.

11. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, wherein the method comprises measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle, wherein the magnitude of the opening or closing force applied to a valve member to urge the said variably timed valve open or closed or to hold the said variably timed valve open or closed is also controlled taking into account the one or more properties measured during the earlier cycle.

12. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, wherein the method comprises measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle, wherein the timing of the opening or closing of the variably timed valve is determined further taking into account a current value of a measured parameter associated with the working chamber.

13. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, wherein the method comprises measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle, wherein either or both of the low pressure valve and the high pressure valve are solenoid operated valves comprising a solenoid and the method comprises measuring at least one electrical property of a said solenoid to obtain at least one of the one or more measured properties.

14. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, and a controller which actively controls one or more said valves to determine the net displacement of fluid by the working chamber on a cycle by cycle basis, at least one of the low pressure valve and the high pressure valve being a variably timed valve, the timing of the opening or closing of which is variable relative to cycles of working chamber volume, wherein the method comprises measuring one or more properties of the performance of the fluid working machine during an earlier cycle of working chamber volume and controlling the timing of the opening or closing of a said variably timed valve during a later cycle of working chamber volume taking into account the one or more properties measured during the earlier cycle, further comprising the steps of estimating the time required for at least one of the low pressure valve or the high pressure valve to either or both open or close, taking into account at least one of the one or more measured properties, and determining the timing of opening or closing of the variably timed valve taking into account the estimated time.

15. A method of controlling a fluid working machine, the fluid working machine comprising a working chamber of cyclically varying volume, a low pressure manifold and a high pressure manifold, a low pressure valve for regulating communication between the low pressure manifold and the working chamber, a high pressure valve for regulating communication between the high pressure manifold and the working chamber, a pressure sensor for measuring a sensed pressure of fluid in the high pressure manifold, and a controller which actively controls one or more said valves to determine the net displacement of working fluid by the working chamber on a cycle by cycle basis and operable to receive the sensed pressure, at least one of the low pressure valve and the high pressure valve being a variably timed valve, the timing of the opening or closing of which is varied relative to cycles of working chamber volume according to a calibration function relating the timing of the opening or closing relative to cycles of working chamber volume to the sensed pressure, wherein the controller modifies the calibration function responsive to an additional parameter which varies in use.

16. A method of controlling a fluid working machine according to claim 15, wherein the variably timed valve is the low pressure valve, and the calibration function relates the sensed pressure to the timing of the closing of the low pressure valve during a pumping or motoring cycle of the fluid working machine such that the low pressure valve closes at the correct time for the working chamber to displace a desired net volume of working fluid.

17. A method of controlling a fluid working machine according to claim 15, wherein the variably timed valve is the high pressure valve, and the calibration function relates the sensed pressure to the timing of the closing of the high pressure valve during a motoring cycle of the fluid working machine such that the high pressure valve closes at the correct time for the working chamber to displace a desired net volume of working fluid.

18. A method of controlling a fluid working machine according to claim 15, wherein the variably timed valve is the low pressure valve, and the calibration function relates the sensed pressure to the timing of the closing of the low pressure valve during a motoring cycle of the fluid working machine to ensure that the low pressure valve closes sufficiently far before Top Dead Centre (TDC) to equalise the pressure between the working chamber and the high pressure manifold, but not so far before TDC that the working chamber emits a significant amount of working fluid to the high pressure manifold.

19. A method of controlling a fluid working machine according to claim 15, wherein the variably timed valve is the high pressure valve, and the calibration function relates the sensed pressure to the timing of the closing of the high pressure valve during a motoring cycle of the fluid working machine to ensure that the high pressure valve closes sufficiently far before Bottom Dead Centre (BDC) to equalise the pressure between the working chamber and the low pressure manifold, but not too far before BDC that the working chamber fails to admit a significant amount of working fluid from the high pressure manifold.

20. A method of controlling a fluid working machine according to claim 15, wherein the additional parameter is a measurement of one or more properties of the working fluid.

21. A method of controlling a fluid working machine according to claim 20, wherein the or a said property of the working fluid is the temperature of the working fluid, or a measurement related to the compressibility of the working fluid.

22. A method of controlling a fluid working machine according to claim 21, wherein the measurement related to the compressibility of the working fluid is determined accounting for entrained gas in the working fluid.

23. A method of controlling a fluid working machine according to claim 15, wherein the additional parameter is derived from a measurement of a property of the operation of the fluid working machine.

24. A method of controlling a fluid working machine according to claim 15, wherein the additional parameter is the rate of cycling of the working chambers of the fluid working machine.

25. A method of controlling a fluid working machine according to claim 24, wherein the measurement of a property of the operation of the fluid working machine is a measurement of one or more properties of the passive opening of one or more valves.

26. A method of controlling a fluid working machine according to claim 24, where the measurement of a property of the operation of the fluid working machine is a measurement of the rate of change of sensed pressure responsive to the net displacement of fluid by a working chamber.

27. A method of controlling a fluid working machine according to claim 15, wherein the calibration function is varied responsive to whether the actual time-averaged net displacement of fluid by the working chamber is substantially the same as an intended time-averaged net displacement of fluid by the working chamber caused by the activation of the variably timed valves relative to cycles of working chamber volume.

28. A method of controlling a fluid working machine according to claim 27, where whether the actual and intended time-averaged net displacements of fluid are substantially the same is determined responsive to the sensed pressure.

29. A method of controlling a fluid working machine according to claim 15, wherein the fluid working machine comprises a shaft sensor for determining the angular position of a rotatable shaft operably linked to the cycles of working chamber volume, and the controller is operable to receive a measurement of shaft angle from the shaft sensor.

30. A method of controlling a fluid working machine according to claim 29, wherein the calibration function determines one or more of an angle component and a time offset component of timing measured relative to the rotation of the rotatable shaft.

31. A method of controlling a fluid working machine according to claim 30, wherein the calibration function is modified responsive to both one or more additional parameter and the stored data.

32. A method of controlling a fluid working machine according to claim 31, wherein the stored data comprises a plurality of stored calibration functions and the controller selects a stored calibration function or functions in use responsive to the additional parameter.

33. A method of controlling a fluid working machine according to claim 31, wherein the stored data comprises calibration function parameters and the controller determines the calibration function from the calibration function parameters and the additional parameters.

34. A process of manufacturing a fluid working machine operable according to the method of claim 30, comprising assembling the fluid working machine, testing the fluid working machine, optimising the performance of the fluid working machine and storing values obtained from said optimisation in the stored data.

35. A method of controlling a fluid working machine according to claim 15, wherein the fluid working machine comprises a memory in communication with the controller, which memory stores data read by the controller in use.

36. A method of controlling a fluid working machine according to claim 35, wherein the controller calculates one or more further parameters with reference to the stored data and current operating conditions of the fluid working machine, and combines the further parameters with the calibration function to determine the timing of the opening or closing of the variably timed valves relative to cycles of working chamber volume.

37. A method of controlling a fluid working machine according to claim 36, wherein the opening or closing of the variably timed valves occurs a time delay after a signal to the variably timed valves, wherein the controller calculates the time delay from the further parameters and controls the timing of the opening or closing of the variably timed valves by the timing of the signal taking into account the time delay.

* * * * *